US006697025B2

(12) United States Patent
Koyanagi et al.

(10) Patent No.: US 6,697,025 B2
(45) Date of Patent: Feb. 24, 2004

(54) ANTENNA APPARATUS

(75) Inventors: Yoshio Koyanagi, Ebina (JP); Hisashi Morishita, Yokosuka (JP); Jun Ito, Yokosuka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/904,689

(22) Filed: Jul. 13, 2001

(65) Prior Publication Data

US 2002/0018021 A1 Feb. 14, 2002

(30) Foreign Application Priority Data

Jul. 19, 2000 (JP) ..... 2000-219228

(51) Int. Cl.[7] ..... H01Q 9/26
(52) U.S. Cl. ..... 343/741; 343/803
(58) Field of Search ..... 343/702, 741, 343/803, 742, 842, 802, 821, 804, 806

(56) References Cited

U.S. PATENT DOCUMENTS 5,808,584 A 9/1998 Skahill ..... 343/803

FOREIGN PATENT DOCUMENTS

WO WO 89/10012 10/1989
WO WO 99/13528 3/1999

*Primary Examiner*—James Clinger
(74) *Attorney, Agent, or Firm*—Pearne & Gordon LLP

(57) ABSTRACT

A one-wavelength loop antenna element (103) shaped like a rectangle is placed close to a radio base plate (101) and further is bent at both end parts toward a feeding section, whereby a current distribution where the current at the tip of turn up becomes zero is formed. Current is concentrated on the loop antenna element (103), so that the current component flowing onto the top of the radio base plate (101) is decreased, the effect produced when a human being carries a radio containing an antenna including the loop antenna element is suppressed, and the directivity responsive to an arrival wave is formed.

20 Claims, 18 Drawing Sheets

ANTENNA APPARATUS

BACKGROUND OF THE INVENTION

This invention relates to an antenna apparatus mainly used with a portable radio and in particular to an antenna apparatus being contained in a portable radio for providing a good radiation characteristic even in a state in which a portable radio is brought close to a human body for use.

In recent years, a demand for mobile radios such as portable telephones has been sharply growing, and a compact, lightweight, and slim radio has been required. Thus, hitherto, a fixed-type helical antenna, a plate-like inverse F antenna, etc., has been used as an antenna and a small-sized antenna system which has good portability and which will not cause an inconvenience when it is used with a small-sized radio is provided.

FIG. 19 is an external view of a fixed-type helical antenna widely used as a portable telephone antenna in a related art. A fixed-type helical antenna element 21 is placed on a portable telephone main unit 20, whereby a compact and lightweight antenna system is provided.

FIG. 20 shows the structure of a plate-like inverse F antenna widely used as an internal antenna of a portable telephone in a related art. The antenna is able to be housed in a portable telephone main unit 20 and can be placed close to the top of a radio base plate. As the antenna, a radiation element 22 is placed close in parallel with a radio base plate 23, a part of the radiation element 22 is grounded to a ground point 24, and power is fed into a part from a feeding point 25, whereby a low-profile antenna is provided and it is made possible to design a portable telephone with an antenna not protrude the portable telephone main unit.

However, with both the fixed-type helical antenna in FIG. 19 and the plate-like inverse F antenna in FIG. 20, much ground current flows not only to the antenna element, but also onto the radio base plate and when the radio is brought close to a human body for use, the antenna is affected by the hands and the head and the gain is degraded largely; this is a problem.

FIG. 21 is a current distribution drawing of the fixed-type helical antenna in the related art. In FIG. 21, wire 26 approximates the radio base plate and the antenna element and an absolute value distribution 27 of current flowing onto the wire 26 when power is fed into the antenna is represented three-dimensionally. It is also seen in the figure that much ground current flows not only onto the helical antenna, but also onto the radio base plate.

FIG. 22 shows a characteristic representing the radiation directivity of the fixed-type helical antenna in the related art. As a result of large ground current flowing not only onto the antenna, but also onto the top of the radio base plate, a $\theta$ component is dominant. Consequently, in a state in which a human being carries the radio and tilts it for use, the polarized wave of an arrival wave from a base station does not match that of the radio antenna and the reception performance largely degraded; this is a problem.

Further, if each of the antennas is miniaturized and is placed in the radio main unit, it is affected by peripheral parts and the radio base plate and becomes a narrow band and the gain is degraded largely; this is a problem.

SUMMARY OF THE INVENTION

It is therefore an object of the invention to realize a balanced system antenna wherein the current component flowing onto a radio base plate is decreased and the gain is less lowered if the antenna is brought close to a human body for use, and provide a small-sized, wide-band, and high-gain antenna apparatus which can operate in a wide band if it is installed close to a radio base plate and can form radiation directivity responsive to an arrival wave.

According to the invention, there is provided an antenna apparatus being contained in a portable radio main unit, the antenna apparatus comprising a loop antenna element shaped like a rectangle with the ratio between a short side and a long side being 10 or more, wherein the loop antenna element has an outer peripheral length which is roughly the same as one wavelength at a first frequency and is placed close in parallel to a radio base plate with a sufficiently small spacing as compared with the wavelength and further is turned up so that the short side is brought close to the feeding section side.

Thus, a current distribution concentrates on the loop antenna element, the current component flowing on the top of the radio base plate can be lessened, and the effect of a human body can be decreased. Further, the antenna element is turned up, whereby it can be miniaturized while it has a wide-band characteristic although the antenna element is placed extremely close to the top of the radio base plate.

The current distribution of the short side of the loop antenna element is zero, so that the current components brought close in parallel do not cancel out each other and highly efficient operation can be performed; the small-sized, high-gain antennal apparatus can be provided.

Since the loop antenna element is connected to the balanced feeding line, the current distribution can be concentrated stably on the loop antenna element One or more passive elements are placed with a sufficiently small spacing as compared with the wavelength along the loop antenna element, so that the antenna apparatus can be provided with a wide-band characteristic and can receive stably in a wide band.

The passive element has a resonance frequency different from the first frequency, so that the antenna apparatus can be provided with a double-resonance or triple-resonance characteristic and can receive at a plurality of frequencies or in a plurality of systems.

A part or the whole of the loop antenna element or the passive element is shaped like a plate, so that the band is further widened and the antenna apparatus can receive stably in a wide band.

The loop antenna element or the passive element is formed on a structure of resin, ceramic, or a printed circuit board, so that a solid and stable antenna system can be provided.

The ratio between a current flowing onto the top of the loop antenna element and a high-frequency current flowing onto the top of the radio base plate is changed, so that the optimum radiation directivity can be formed in response to change in the operating environment or arrival radio wave, and a highly sensitive antenna system can be provided. As means for changing the high-frequency current ratio, adjustment means for providing a phase difference between high-frequency signals supplied from the balanced feeding line can be provided or the loop antenna element or the passive element is asymmetrical with respect to the feeding section.

DETAILED DESCRIPTION OF THE PREFERRED EMBODIMENTS

Referring now to the accompanying drawings (FIGS. 1 to 18), there are shown preferred embodiments of the invention.

(Embodiment 1)

Figure 1:
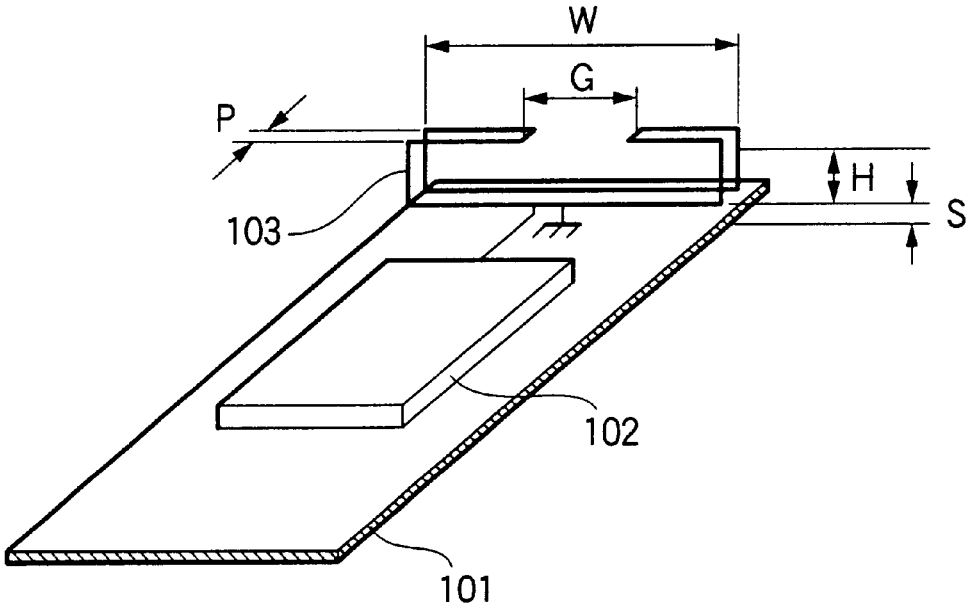
FIG. 1 is a drawing to show a first embodiment of an antenna apparatus of the invention.

FIG. 1 shows a first embodiment of an antenna apparatus of the invention. In the figure, numeral 101 denotes a radio base plate, numeral 102 denotes a radio circuit, and numeral 103 denotes a loop antenna element. The loop antenna element 103 is connected at one end to the radio circuit 102 and is grounded at an opposite end to the radio base plate 101. The antenna apparatus is housed in a case of a radio.

In FIG. 1, a copper plate of a size of $0.77\lambda \times 0.23\lambda$ ($\lambda$ is wavelength at first frequency) is used as the radio base plate 101, but a pattern may be formed on the printed circuit board for use as the radio base plate. The loop antenna element 103 has a form provided by turning up a rectangle with a long side $2W+2H-G$ and a short side P, and has sizes of lateral width $W=0.233\lambda$, longitudinal width $P=0.0033\lambda$, and height $H=0.067\lambda$ after the rectangle is turned up. The loop antenna element 103 is placed close in parallel to the radio base plate 101 with a spacing $S=0.0067\lambda$ sufficiently small as compared with the wavelength relative to the radio base plate 101. Copper wire with a wire diameter $0.005\lambda$ is used as a wire rod, but a belt-like pattern may be formed.

Both end parts of the loop antenna element 103 are turned up in a direction perpendicular to the radio base plate 101 with the lateral width W and is further turned up inside at the height $H=0.067\lambda$ for bringing the loop antenna element 103 close to the feeding section side. In FIG. 1, the loop antenna element 103 turned up at both ends is brought close up to a gap $G=0.067\lambda$, but maybe bent once more to the feeding section side.

The turned-up loop antenna has an outer peripheral length $L=4W+4H-2G+2P=1.07\lambda$, which is a length of about one wavelength. The ratio between the short and long sides of the original rectangle of expanding the loop antenna element 103 shown in the figure is $(2W+2H-G)/P=161.5$.

Figure 2:
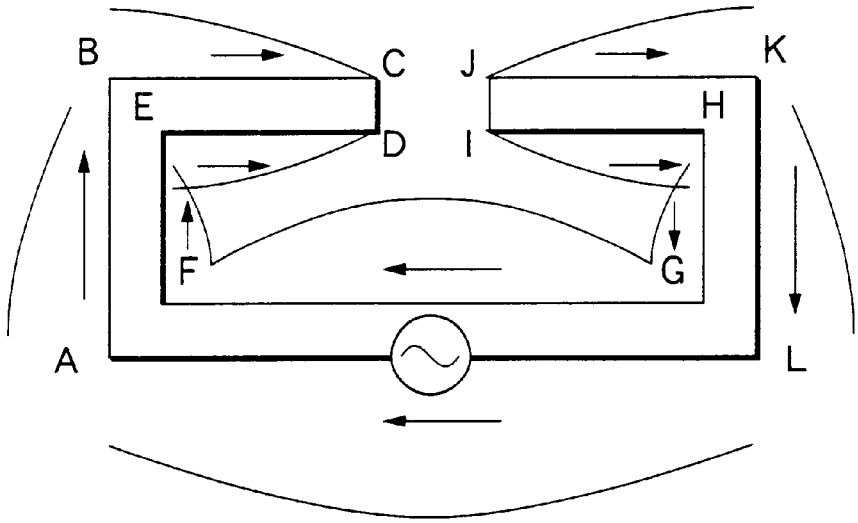
FIG. 2 is a drawing to describe the operation principle of the antenna apparatus in FIG. 1

FIG. 2 is a drawing to describe the operation principle of the antenna apparatus in FIG. 1. An electric current supplied from the feeding section flows from point A to point L. Since the full outer peripheral length is about one wavelength, knots and bellies of a current distribution occur alternately every quarter the wavelength and the phase is inverted at the knot portion. In FIG. 2, C-D and I-J portions of the short sides of the rectangular correspond to knots and thus the electric distribution becomes almost equal to zero; L-A and F-G portions correspond to bellies and thus the electric distribution becomes almost the maximum. The phase relationship becomes opposite in D-I and J-C and thus the current distribution is opposite phase, identical amplitude on all routes brought close in parallel. Thus, the current components brought close in parallel do not cancel out each other and highly efficient operation can be performed.

The length of the short side of the rectangle should be small as compared with the length of the long side as the condition under which the C-D and I-J portions correspond to knots, and such a current distribution is provided by forming so that the ratio between the short and long sides becomes 10 or more.

In A-B and E-F portions and G-H and K-L portions, the current distribution is opposite phase, identical amplitude mutually and thus when viewed in a distant field, the radiation electric field components in the portions cancel out each other to zero. However, in B-C, D-E, H-I, and J-K portions and L-A and F-G portions, amplitude distributions differ although the phases are opposite and particularly the current component in the center portion of L-A, F-G is large and thus the portion operates effectively as a radiation component.

In FIG. 2, the feeding section is shown as a balanced feeding type. However, even if the feeding section is of unbalanced feeding type with single-side ground and single-side feeding, if the ground point and the feeding point are close to each other and the loop antenna element is made symmetrical, operation is performed with similar current distribution and thus the current induced to the radio base plate from the ground point can be decreased.

Figure 3A:
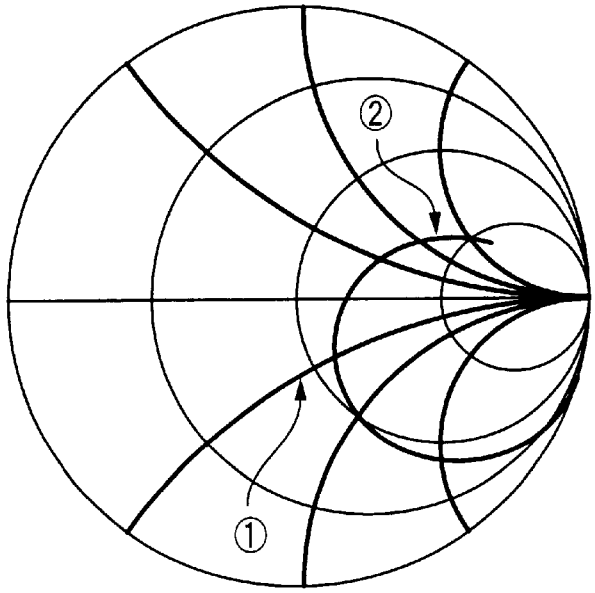
FIGS. 3A and 3B are an impedance characteristic drawing of the antenna apparatus in FIG. 1.
Figure 3B:
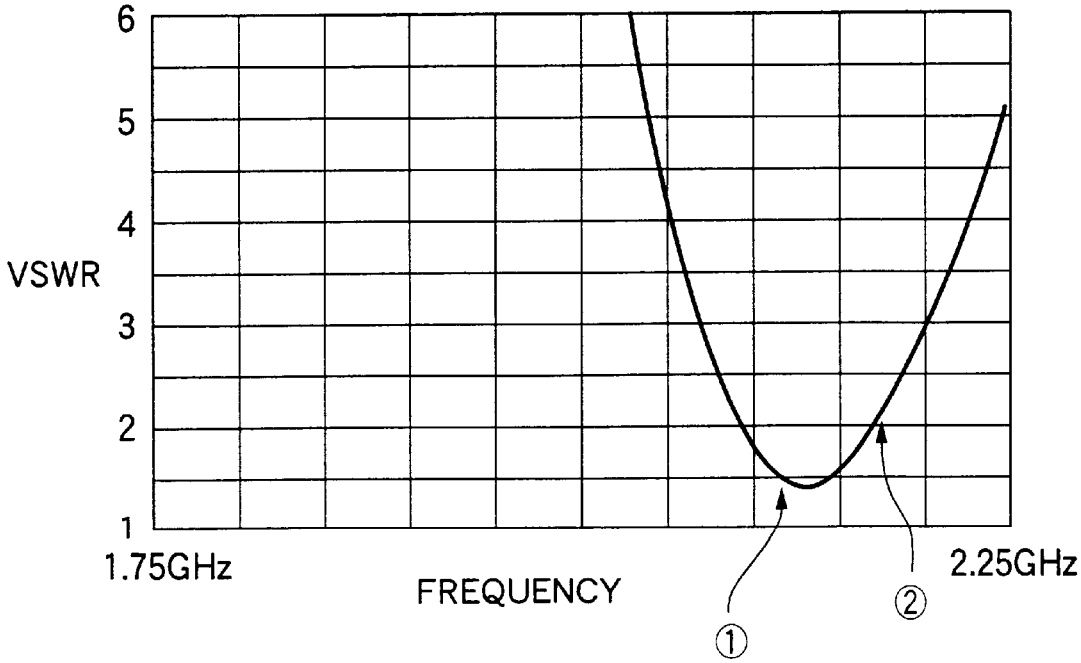

FIGS. 3A and 3B shows an impedance characteristic of the antenna apparatus described with reference to FIG. 1. FIG. 3A is a Smith chart. In FIG. 3B, the vertical axis represents VSWR (Voltage Standing Wave Ratio) and the horizontal axis represents frequencies. Generally, a loop antenna brought close to a base plate is a narrow band, but with the loop antenna shown, VSWR<2.5 is provided at desired reception frequencies 2110 MHz to 2170 MHz as resonance frequencies and thus the loop antenna is a wide band.

Figure 4:
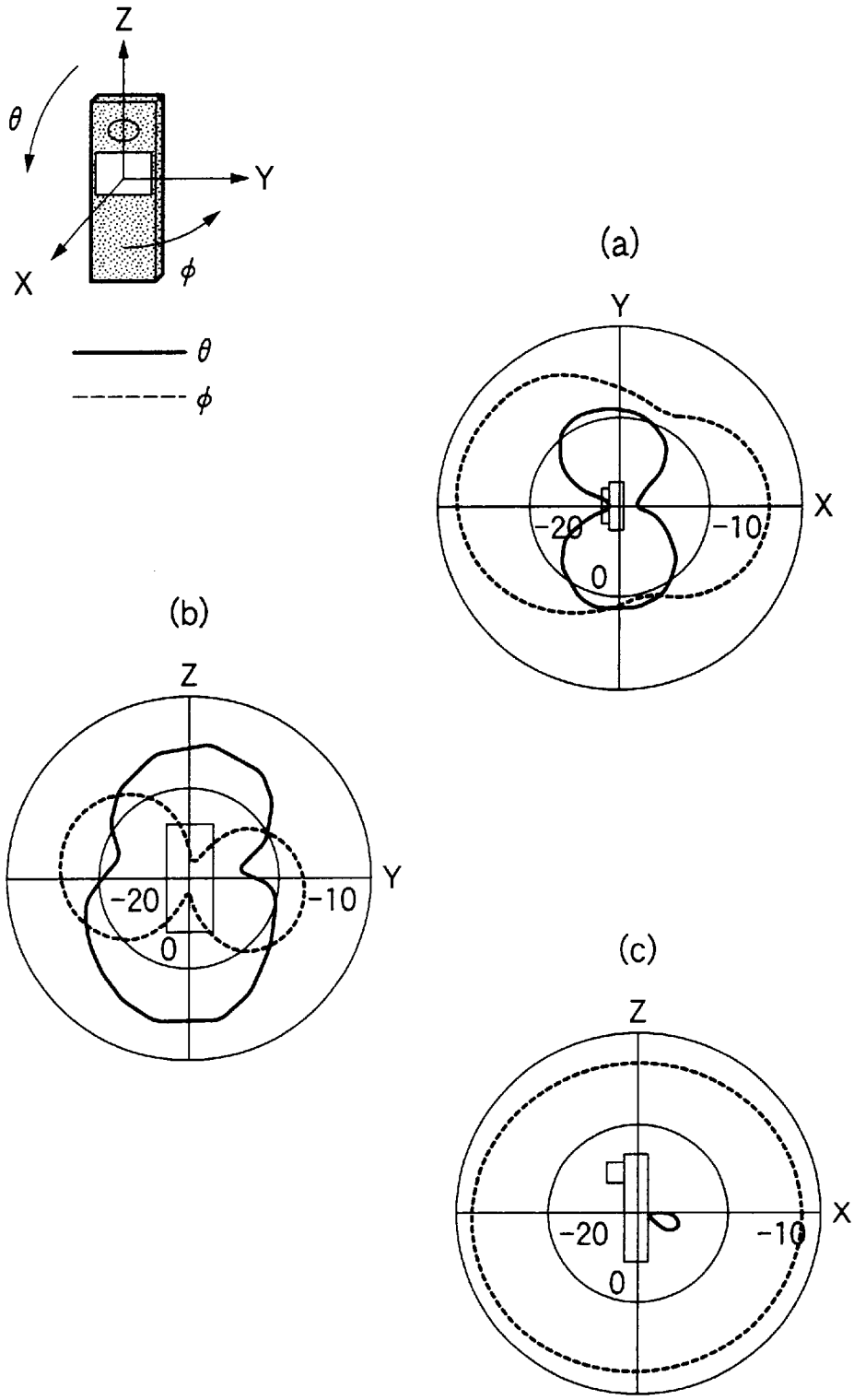
FIG. 4 is a characteristic drawing to show the radiation directivity of the antenna apparatus in FIG. 1.
Figure 22:
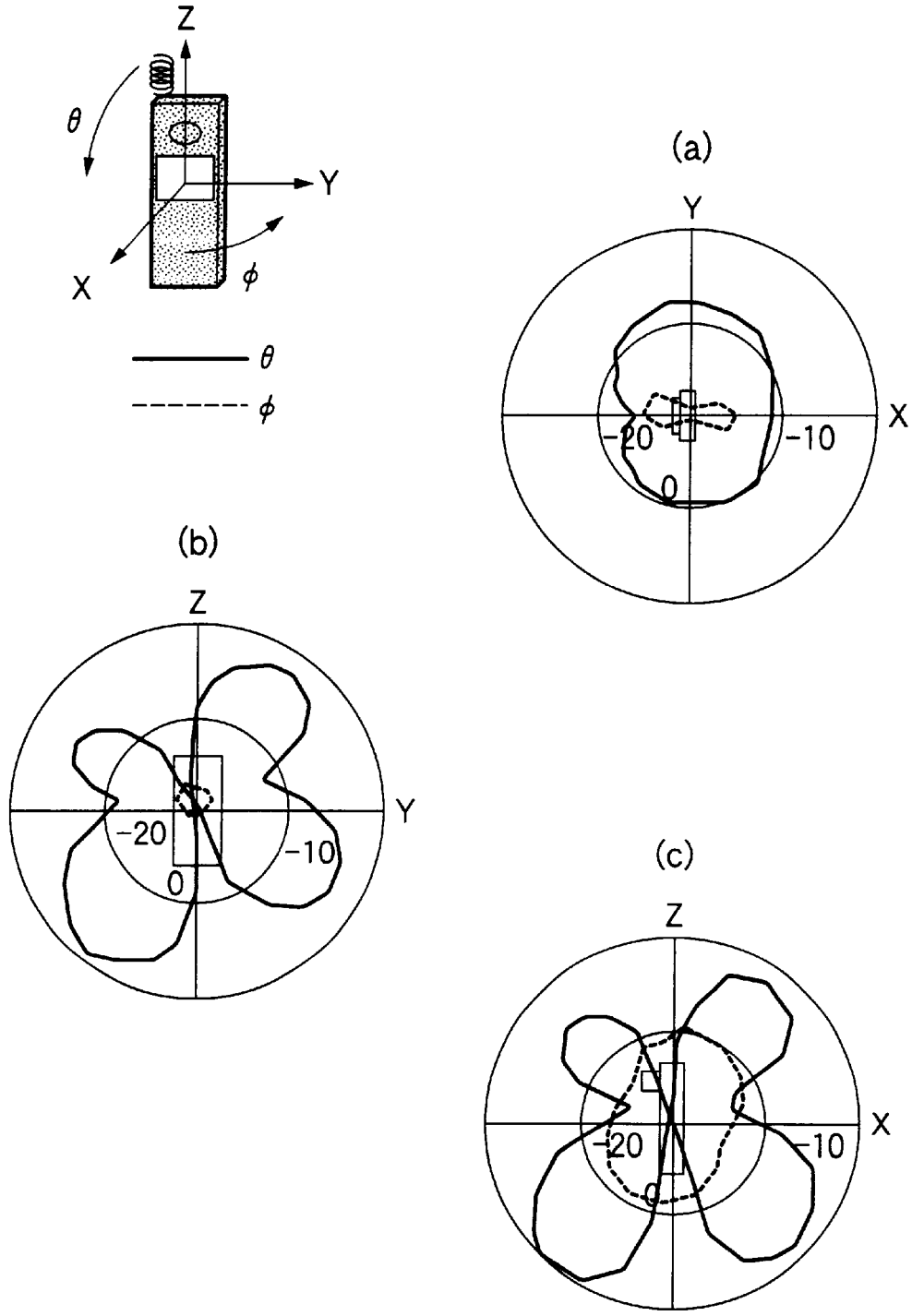
FIG. 22 is a characteristic drawing to show the radiation directivity of the fixed-type helical antenna in the related art.

FIG. 4 shows a characteristic of the radiation directivity of the antenna apparatus described with reference to FIG. 1. In radiation directivity patterns in FIGS. 4(*a*), (*b*), and (*c*), each solid line indicates θ component of electric field (Eθ) and each dotted line indicates ϕ component of electric field (Eϕ). In the coordinate system shown in FIG. 4, the electric field ϕ component is radiated in the −X axis direction and more electromagnetic wave radiates in an opposite direction to a human body in a call state as the directivity pattern; electromagnetic wave absorption in a human body can be decreased. In the radiation directivity of the fixed-type helical antenna in the related art shown in FIG. 22, the θ component is dominant in any directions and when the radio is tilted, the polarized wave does not match the polarized wave from the base station. In contrast, in FIG. 4(*b*), the θ component becomes close to a vertically polarized wave during the call state when the antenna is tilted at 60 degrees on the Y-Z plane for use, so that it becomes easy to receive the vertically polarized wave of the main polarized wave of the arrival wave from a base station and the reception performance in an actual radio wave environment is enhanced.

Figure 5:
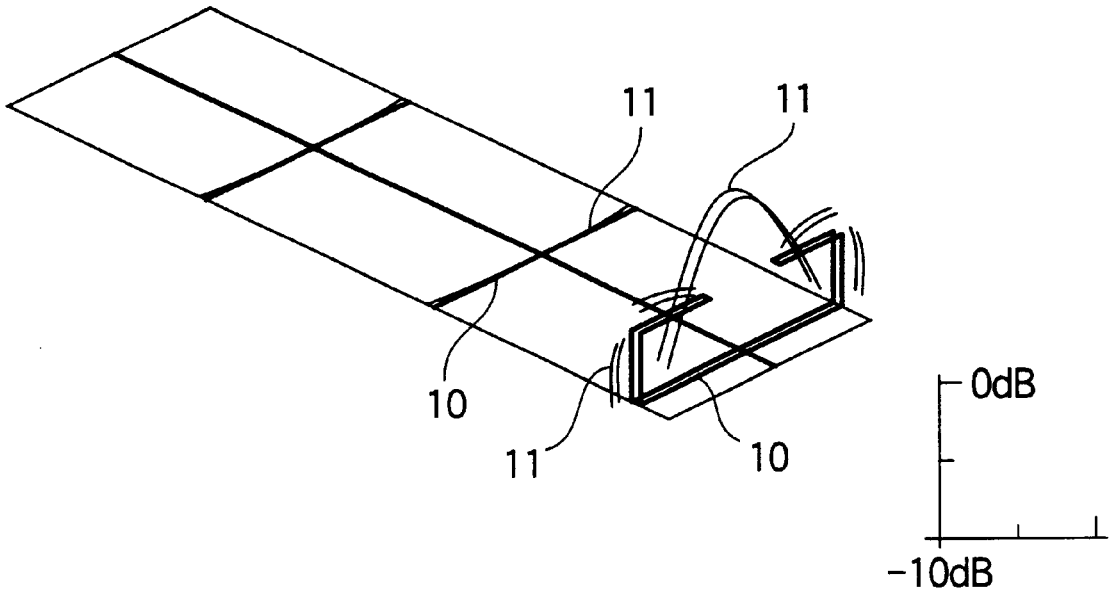
FIG. 5 is a current distribution drawing of the antenna apparatus in FIG. 1.
Figure 21:
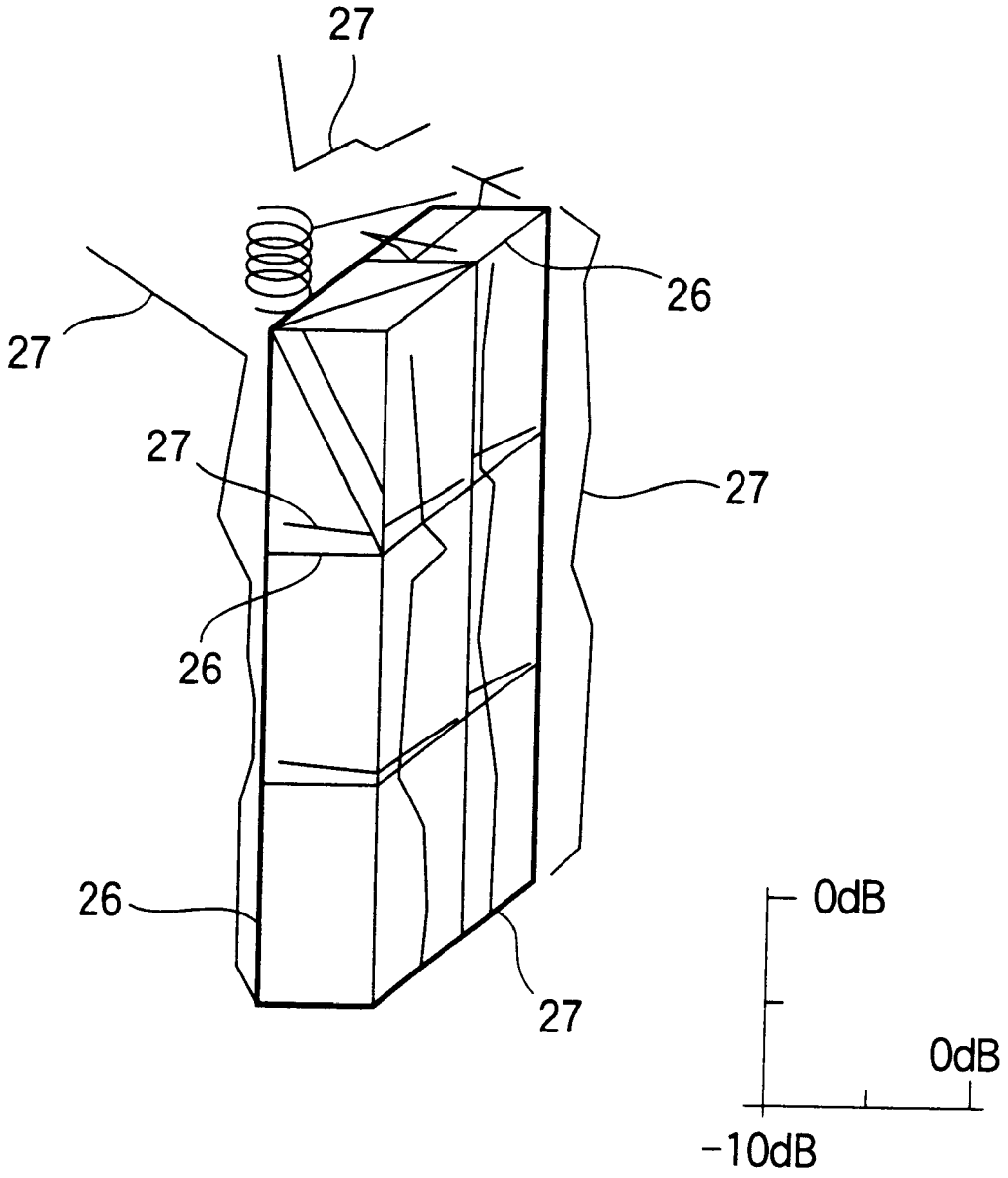
FIG. 21 is a current distribution drawing of the fixed-type helical antenna in the related art.

FIG. 5 is a current distribution drawing of the antenna apparatus of the first embodiment. In FIG. 5, wire 10 approximates the radio base plate and the antenna element and an absolute value distribution 11 of current flowing onto the wire 10 when power is fed into the antenna is represented three-dimensionally. It is seen that balanced current flows onto the loop antenna element 103 and thus large ground current does not flow onto the top of the radio base plate. From the current distribution, it is seen that the current flowing onto the radio base plate is very small as compared with the current distribution of the fixed-type helical antenna in the related art shown in FIG. 21. If the current on the radio base plate is much as in FIG. 21, the base plate also operates as a part of the antenna and thus when a human being carries it, the current distribution largely changes, resulting in change in the antenna impedance and degradation of the radiation efficiency. However, the effect of the human body can be decreased by lessening the current on the radio base plate as in FIG. 5. The current on the radio base plate causes local absorption power to occur when the radio is brought close to the head of a human body, and the antenna apparatus of the invention can also decrease the SAR (Specific Absorption Rate).

Figure 6G:
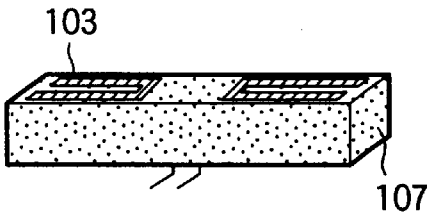
FIGS. 6A to 6G show loop antenna element configuration examples.
Figure 6D:
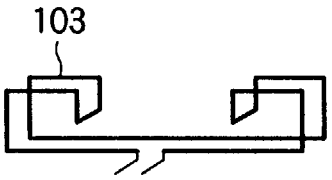
Figure 6E:
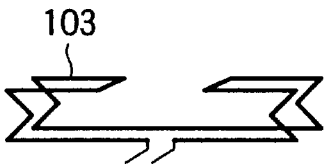
Figure 6F:
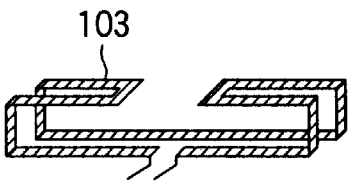
Figure 6A:
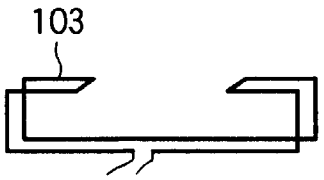
Figure 6B:
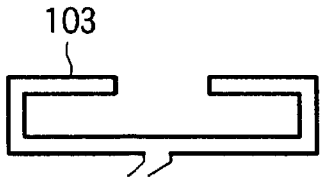
Figure 6C:
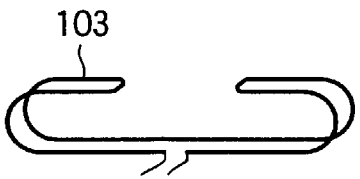

FIGS. 6A to 6G schematically represent configuration examples of the loop antenna element 103. FIG. 6A shows a configuration wherein the loop antenna element 103 has a loop opening face in parallel with the radio base plate 101 and both end parts are bent twice toward the feeding section like that shown in FIG. 1, so that the loop antenna element 103 can be miniaturized while it has a wide-band characteristic. FIG. 6B shows a configuration wherein the loop antenna element 103 has a loop opening face perpendicular to the radio base plate 101 and both end parts are bent twice toward the feeding section relative to the radio base plate 101; the loop antenna element 103 can be slimmed in the width direction while it has a wide-band characteristic. FIG. 6C shows a configuration wherein the bends of the loop antenna element 103 are made smooth; since current flows smoothly, efficiency degradation can be suppressed. Any points may be bent smoothly. FIG. 6D shows a configuration wherein the loop antenna element 103 is further bent at tip parts toward the feeding section, namely, both end parts are bent three times in total; the loop antenna element 103 can be furthermore miniaturized. FIG. 6E shows a configuration wherein the loop antenna element 103 is bent like a crank after the first bending and both end parts are bent three times in total; the loop antenna element 103 can be furthermore miniaturized. FIG. 6F shows a configuration wherein the loop antenna element 103 is formed like a plate, so that the band is further widened and stable reception is enabled in a wide band. The portion formed like a plate may be a part. FIG. 6G shows a configuration wherein the loop antenna element 103 is patterned on a structure 107 of resin, ceramic, a printed circuit board, etc.; it has a solid structure and can be manufactured stably with high accuracy. Further, if the radio base plate 101 is made of a printed circuit board, the radio base plate 101 and the loop antenna element 103 can be easily assembled by surface mounting.

The peripheral length of the loop antenna element 103 is thus made about one wavelength, so that the ground current flowing onto the radio base plate 101 can be decreased. The antenna is brought close to the radio base plate 101, whereby the radio can be molded like a slim shape, it is also made possible to install the antenna on the printed circuit board of the radio, and the radiation component in the base plate direction can be decreased. Further, generally the loop antenna brought close to a metal plate becomes a low impedance and a narrow band, but the structure wherein tip parts of the loop antenna element 103 are bent and is brought distant from the radio base plate 101 is adopted, so that a wide band can be provided.

(Embodiment 2)

Figure 7:
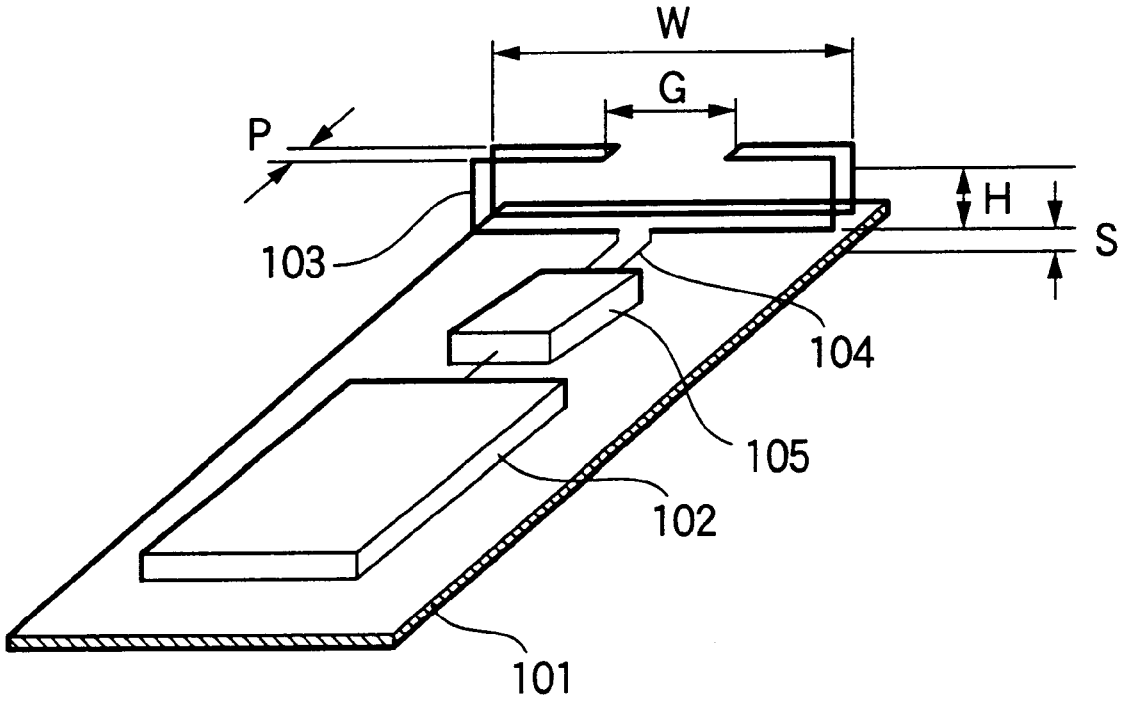
FIG. 7 is a drawing to show a second embodiment of an antenna apparatus of the invention.

FIG. 7 shows a second embodiment of an antenna apparatus of the invention. In the antenna apparatus, feeding into a loop antenna element 103 in balance is performed, whereby a current distribution is concentrated stably on the loop antenna element. The second embodiment is the same as the first embodiment except that feeding into the loop antenna element 103 is performed from a radio circuit 102 via a balun 105 and a balanced feeding line 104 in a balanced system as shown in FIG. 7.

The balun 105 is placed to mediate between unbalanced and balanced systems if the radio circuit 102 is connected to a feeding line in an unbalanced system. If output of the radio circuit 102 is originally formed of a balanced system, the radio circuit 102 and the loop antenna element 103 can be directly connected by the feeding line 104 not via the balun 105. For example, the balun 105 in the embodiment uses a 1:4 impedance converter. The radio circuit 102 has an output impedance of 50[Ω]; the balanced feeding line 104 and the loop antenna element 103 have each an input impedance of 200[Ω]. The 200[Ω] loop antenna is subjected to 1:4 impedance conversion, whereby it operates in a wider band. Balanced feeding into the loop antenna element 103 is performed, whereby the loop antenna element 103 can be stably operated in balance.

Figure 8A:
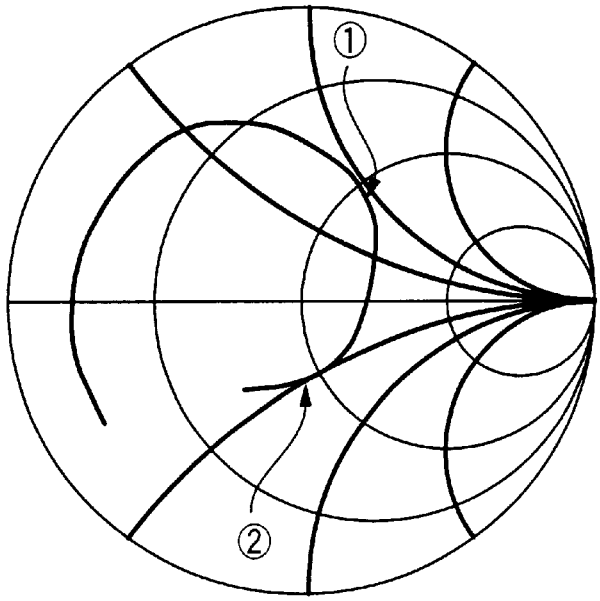
FIGS. 8A and 8B are an impedance characteristic drawing of the antenna apparatus in FIG. 7.
Figure 8B:
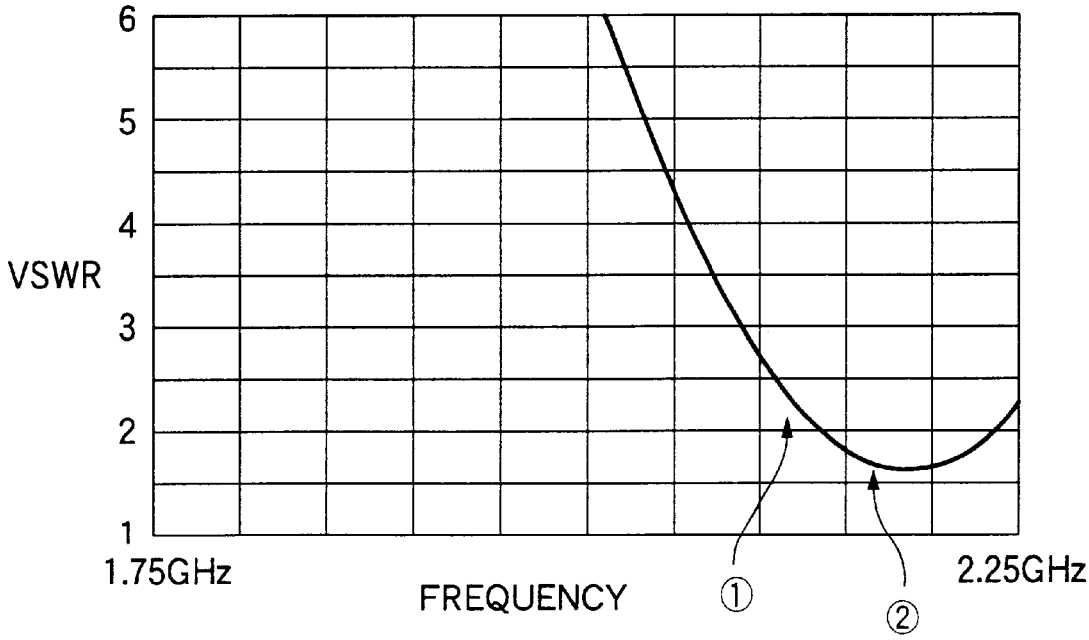

FIGS. 8A and 8B is an impedance characteristic drawing of the antenna apparatus described with reference to FIG. 7; FIG. 8A is a Smith chart, and the vertical axis of FIG. 8B represents VSWR and the horizontal axis represents frequencies. The impedance in the figure is applied when the balun 105 is used, and thus is normalized with 200[Ω]. It is seen that the band is a wider band as compared with the impedance characteristic in FIG. 3. The basic characteristics of the radiation directivity, current distribution, etc., of the antenna apparatus are the same as those of the antenna apparatus of the first embodiment.

(Embodiment 3)

Figure 9:
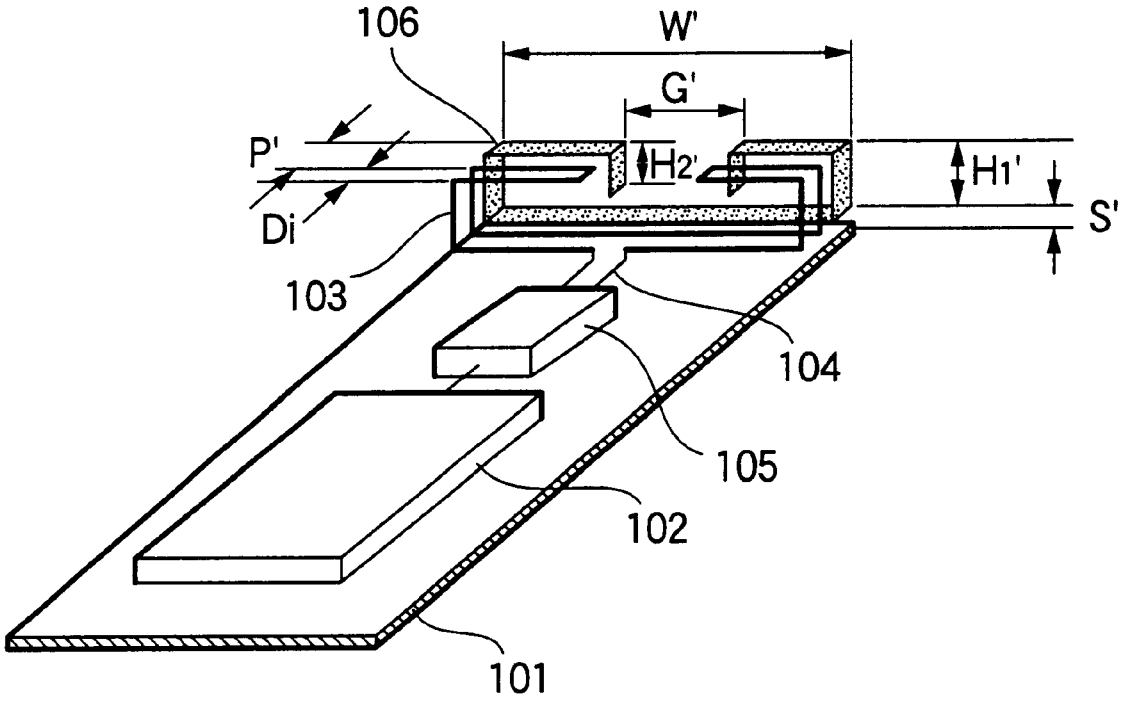
FIG. 9 is a drawing to show a third embodiment of an antenna apparatus of the invention.

FIG. 9 shows a third embodiment of an antenna apparatus of the invention. The third embodiment is the same as the second embodiment except that the antenna apparatus further comprises one or more passive elements 106, whereby it is operated in a wider band, and except that the passive element 106 is placed with a sufficiently small spacing as compared with the wavelength along a loop antenna element 103 as shown in FIG. 9.

The passive element 106 has lateral width W'=0.233λ and longitudinal width P'=0.0132λ, and is placed close almost in parallel to a radio base plate 101 with a spacing S'=0.0067λ sufficiently small as compared with the wavelength. Both end parts of the passive element 106 are turned up in a direction perpendicular to the radio base plate 101 and is further turned up inside at the height H1'=0.067λ. In FIG. 9, the passive element 106 turned up at both ends is brought close up to a gap G'=0.067λ and is turned up once more inside by H2'=0.033λ. The bent passive element 106 has a full length L'=2W'+2H1'−G'+2H2'=0.599λ, which is a length of 0.6 wavelength relative to the first frequency and is a length corresponding to almost a half the wavelength relative to the second frequency for dual resonance.

Thus, the passive element 106 has a self-resonance characteristic corresponding to the second frequency different from the first frequency of the loop antenna element 103 and is brought close to the loop antenna element 103, whereby they are electromagnetically coupled, making it possible for the antenna apparatus to operate in a plurality of bands.

If the passive element 106 is placed so that the center of the passive element 106 comes to the vicinity of the center at which the current of the loop antenna element 103 reaches the maximum, the couple degree reaches the maximum.

In FIG. 9, the passive element 106 is placed in parallel at a distance DI'=0.0132λ from the loop antenna element 103. Since the electromagnetic couple degree can be adjusted in response to the distance and the positional relationship, so that any desired wide-band characteristic or dual resonance characteristic can be produced.

In the antenna apparatus in FIG. 9, feeding is performed over the balanced feeding line 104 using a balun 105. However, even if the feeding is unbalanced feeding, if a balanced current distribution is formed on the antenna, a similar advantage can be provided.

Figure 10A:
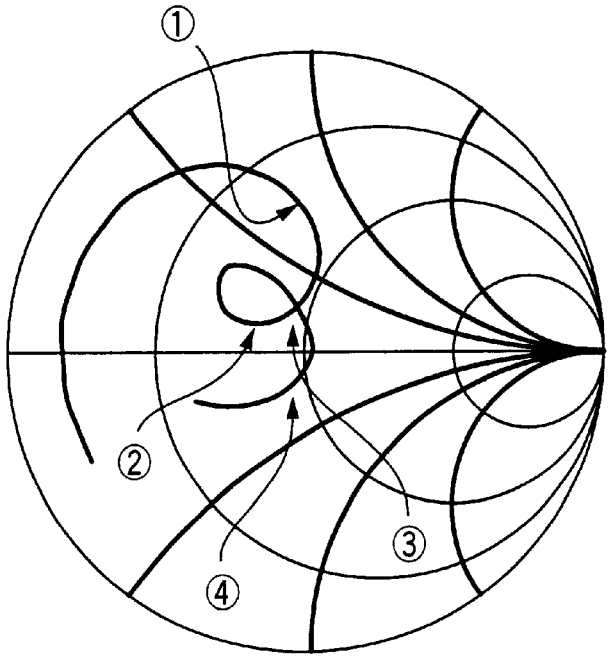
FIGS. 10A and 10B are an impedance characteristic drawing of the antenna apparatus in FIG. 9.
Figure 10B:
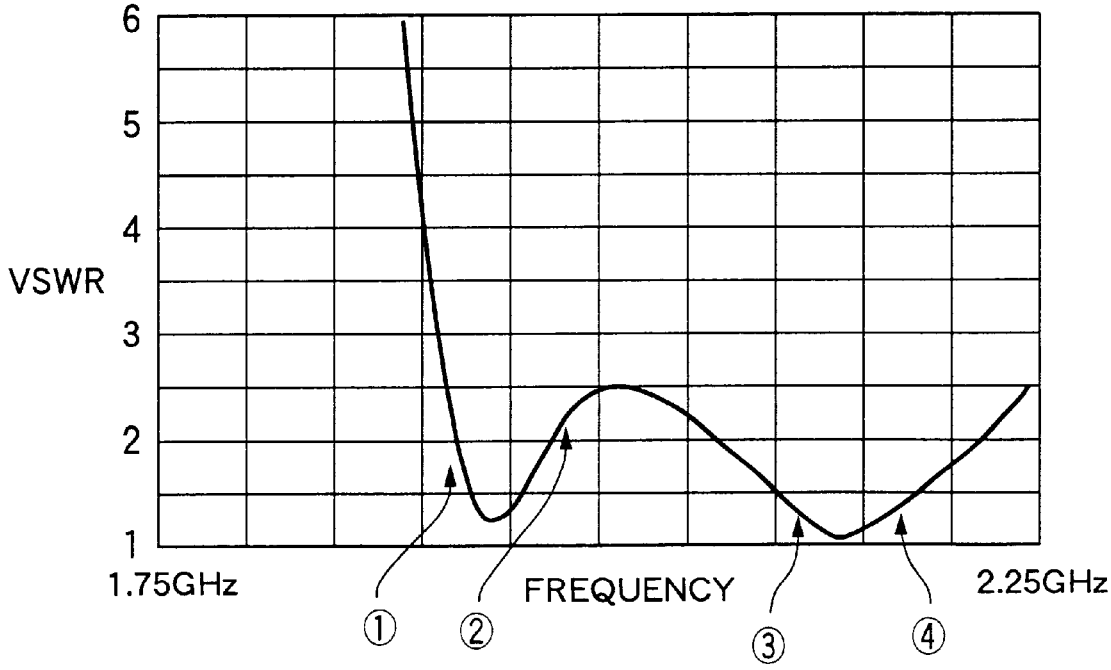

FIGS. 10A and 10B is an impedance characteristic drawing of the antenna apparatus described with reference to FIG. 9. FIG. 10A is a Smith chart. The vertical axis of FIG. 10B represents VSWR and the horizontal axis represents frequencies. The impedance in the figure is applied when the balun 105 is used, and thus is normalized with 200 ohms. In the antenna apparatus, VSWR<2.5 is provided in both the first frequency band 2110 MHz to 2170 MHz and the second frequency band 1920 MHz to 1980 MHz, and it is seen that the antenna apparatus operates in a plurality of bands.

Figure 11A:
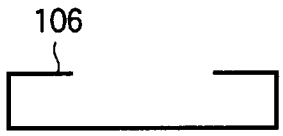
FIGS. 11A to 11F show passive element configuration examples.
Figure 11D:
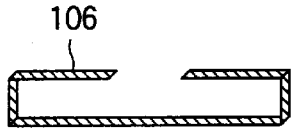
Figure 11B:
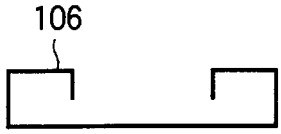
Figure 11E:
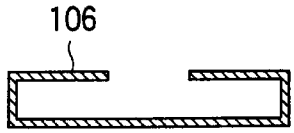
Figure 11C:
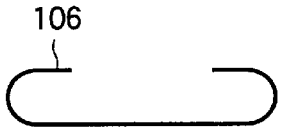
Figure 11F:
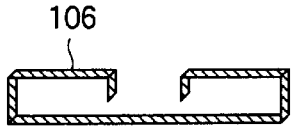

FIGS. 11A to 11F schematically represent configuration examples of the passive element 106. FIG. 11A shows a configuration wherein the passive element 106 is formed of a wire-like conductor and is twice bent perpendicularly to and in parallel with the radio base plate 101; the passive element 106 is turned up in a similar direction to that of the loop antenna element 103, whereby the passive element 106 can be miniaturized while the electromagnetic couple degree is maintained. FIG. 11B shows a configuration wherein the passive element 106 in FIG. 11A is further bent inside and both end parts are bent three times in total; the passive element 106 can be miniaturized more than that in FIG. 11A . FIG. 11C shows a configuration wherein the bends of the passive element 106 are made smooth; since current flows smoothly, efficiency degradation can be suppressed. Any points may be bent smoothly. FIGS. 11D to 11F show configurations wherein the passive elements 106 shown in FIGS. 11A and 11B are formed each like a plate, so that the band is further widened and stable reception is enabled in a wide band.

If each of the passive elements 106 is patterned on the structure 107 of resin, ceramic, a printed circuit board, etc., shown in FIG. 6G integrally with the loop antenna element 103, it can be manufactured solidly and the positional relationship between the loop antenna element 103 and the passive element 106 can be kept with high accuracy, so that it can be manufactured stably.

(Embodiment 4)

Figure 12:
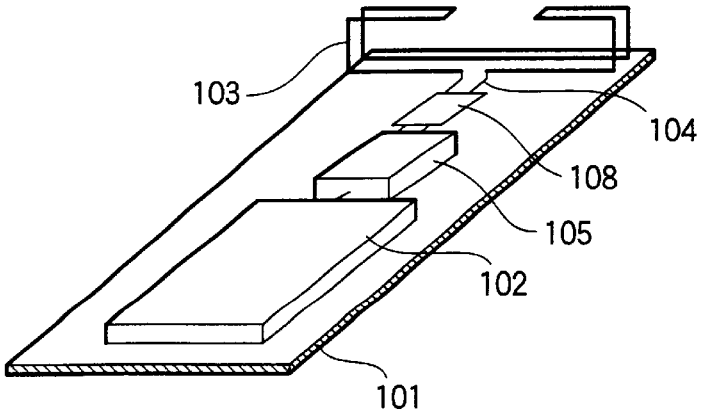
FIG. 12 is a drawing to show a fourth embodiment of an antenna apparatus of the invention.

FIG. 12 shows a fourth embodiment of an antenna apparatus of the invention. In the antenna apparatus, a phase difference is provided between electromotive force supplied from balanced feeding lines, thereby changing current flowing onto the top of a loop antenna element 103 and current flowing onto the top of a radio base plate 101, making it possible to form the radiation directivity fitted to the operating environment and arrival radio wave. A phase circuit 108 is placed between a balanced feeding line 104 and a balun 105, as shown in FIG. 12. Other configuration points are similar to those of the antenna apparatus of the second embodiment.

The phase circuit 108 changes the phase difference between electromotive voltages between balanced lines for feeding into the loop antenna element 103 and has a function of unbalancing a current distribution on the loop antenna element 103 by providing a fixed value or an adjustment circuit. The phase circuit 108 may be placed in the balun 105 or a balun provided with an arbitrary phase difference at any desired frequency can be used to produce a similar effect.

Figure 13:
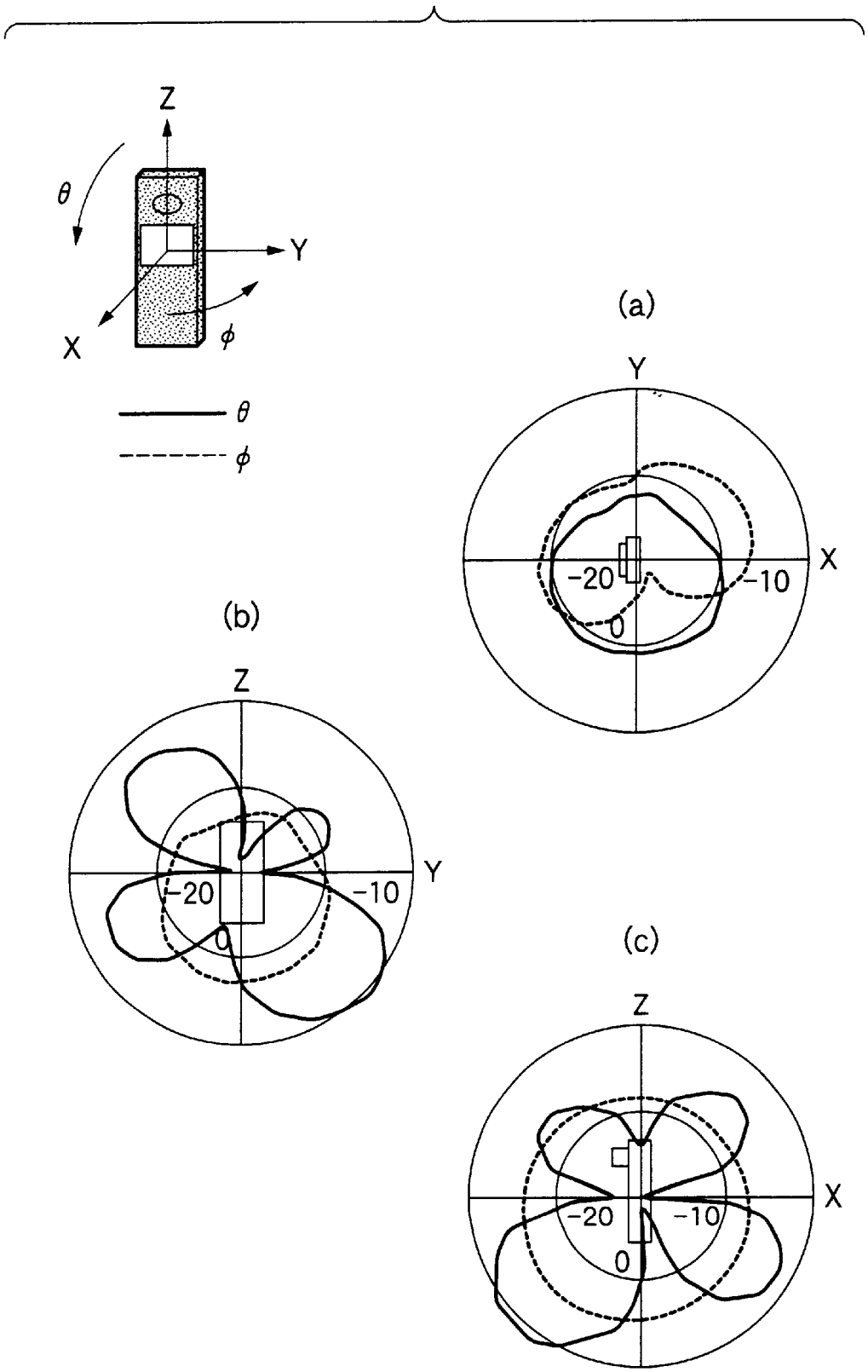
FIG. 13 is a characteristic drawing to show the radiation directivity of the antenna apparatus in FIG. 12.

FIG. 13 is a characteristic drawing to show the radiation directivity of the antenna apparatus described with reference to FIG. 12. In radiation directivity patterns in FIG. 13(*a*), (*b*), and (*c*), each solid line indicates θ component of electric field (Eθ) and each dotted line indicates ϕ component of electric field (Eϕ). FIG. 13 shows the radiation directivity patterns provided when the phase circuit 108 is operated. The radiation directivity patterns change to directivity apparently different from that in FIG. 4 and become radiation directivity patterns close to the radiation directivity of the helical antenna in the related art shown in FIG. 22. The reason is as follows: As the phase difference of the phase circuit 108 is increased and the state is brought close to an unbalanced state from a balanced state, ground current flows onto the radio base plate 101 and thus the antenna operates as an unbalanced system antenna.

The phase circuit 108 is thus adjusted, whereby it is made possible to switch the state between the balanced state and the unbalanced state or provide a state therebetween in response to the operating environment and arrival radio wave, and one antenna system can form a plurality of radiation directivity patterns. Thus, a highly sensitive antenna system can be provided by executing a diversity reception technique or a directivity control reception technique using a function capable of changing the radiation directivity of the antenna apparatus of the invention.

Figure 14A:
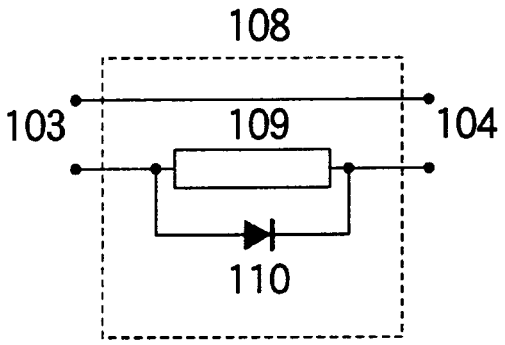
FIGS. 14A and 14B show phase circuit configuration examples.
Figure 14B:
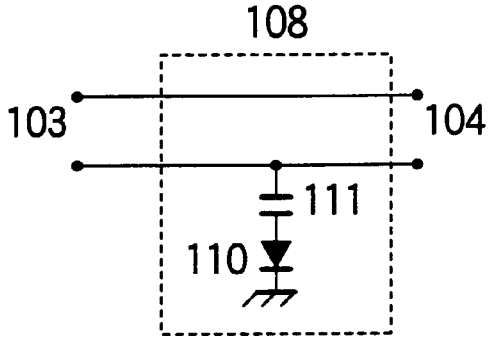

FIGS. 14A and 14B show configuration examples of the phase circuit 108. In FIG. 14A, a microstrip line 109 is used in the phase circuit and when a PIN diode 110 is turned on, the balanced state can be set and when the PIN diode 110 is turned off, the unbalanced state can be set; two types of radiation directivity can be switched. In FIG. 14(*b*), a capacitor 110 is used in the phase circuit and when a PIN diode 111 is turned on, the unbalanced state can be set and when the PIN diode 110 is turned off, the balanced state can be set. In FIG. 14(*b*), a varicap diode may be used in place of the PIN diode 110; in doing so, it is made possible to continuously change the phase difference and the radiation directivity can be switched continuously.

(Embodiment 5)

Figure 15:
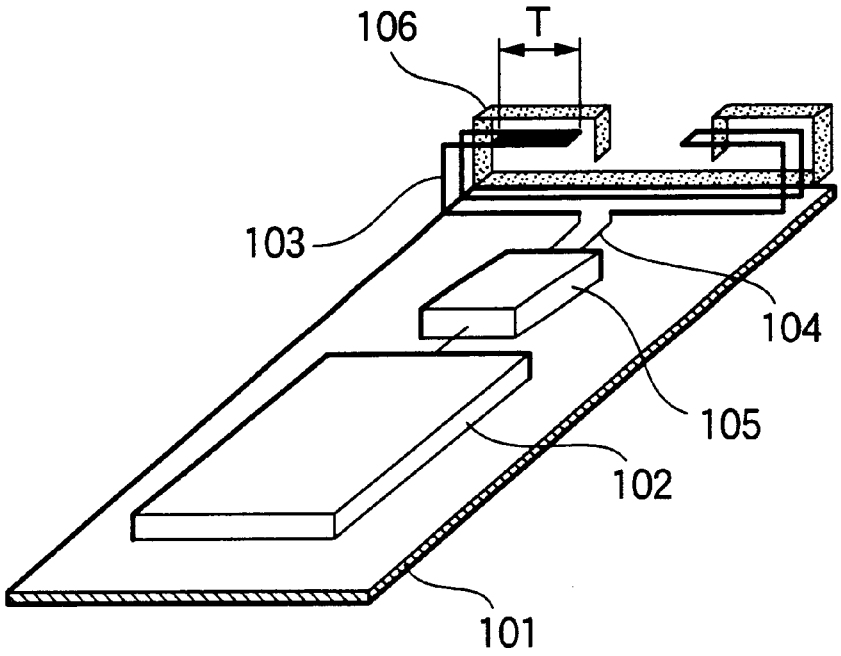
FIG. 15 is a drawing to show a fifth embodiment of an antenna apparatus of the invention.

FIG. 15 shows a fifth embodiment of an antenna apparatus of the invention. In the antenna apparatus, a loop antenna element or a passive element is made asymmetrical with respect to a feeding section for intentionally increasing a current component on a radio base plate 101. As shown in FIG. 15, one side of an opening face of a loop antenna element 103 is closed by T=0.03λ from the tip part. Other configuration points are similar to those of the antenna apparatus of the third embodiment.

Accordingly, in a first frequency band resonated by the loop antenna element 103, an unbalanced current flows onto the top of the radio base plate 101 and the component caused by the current increases on radiation directivity pattern. However, a passive element 106 is placed symmetrically with respect to a feeding point and thus in a second frequency band resonated by the passive element 106, no current flows onto the top of the radio base plate 101 because of the balanced operation and the radiation directivity pattern is the same as that in the first embodiment. As means for making the loop antenna element 103 asymmetrical with respect to the feeding section, means for changing the side-to-side length from the feeding section to the turn-up end, shifting the position of the feeding section from the center, partially changing width P or height H, short-circuiting a part of the opening face by diode, etc., or the like is possible in addition to closing a part of the opening face; if any means is adopted, a similar effect can be produced. As means for making the passive element 106 asymmetrical with respect to the feeding section, means for making asymmetrical positional relationship with the loop antenna element 103, changing the side-to-side length, or the like is possible. In this case, in the second frequency band provided by the passive element 106, unbalanced operation is performed and the radiation directivity pattern changes.

Figure 16A:
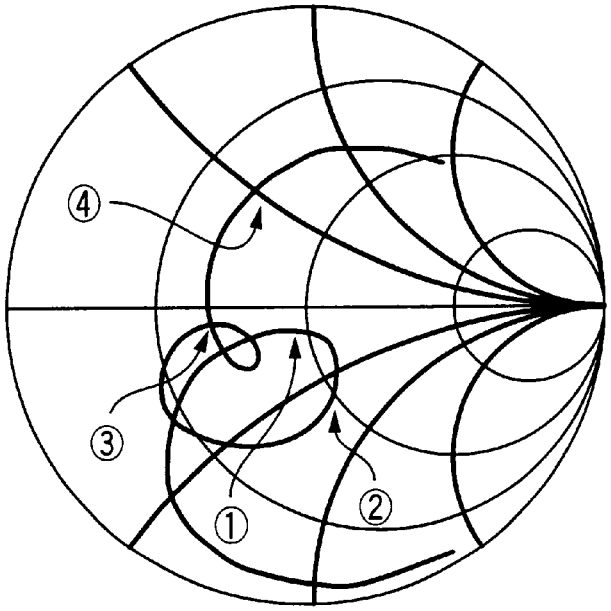
FIGS. 16A and 16B are an impedance characteristic drawing of the antenna apparatus in FIG. 15.
Figure 16B:
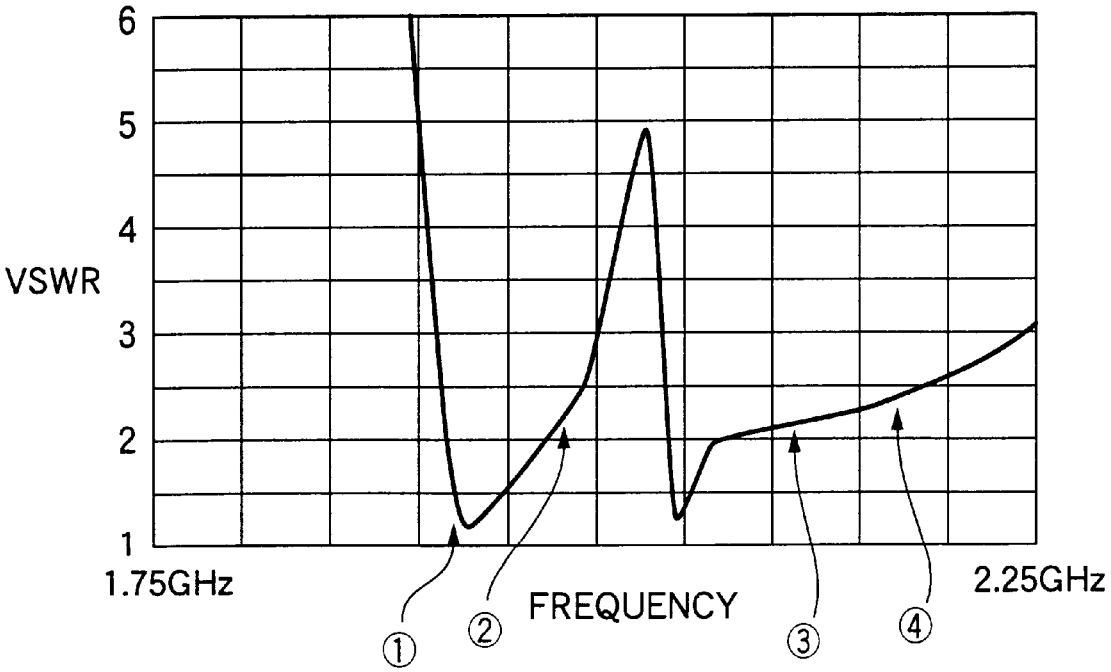

FIGS. 16A and 16B is an impedance characteristic drawing of the antenna apparatus described with reference to FIG. 15. FIG. 16A is a Smith chart. The vertical axis of FIG. 16B represents VSWR and the horizontal axis represents frequencies. The band is slightly narrow as compared with the impedance characteristic drawing of FIG. 10, but VSWR<2.5 is provided in both the second frequency band 1920 MHz to 1980 MHz and the first frequency band 2110 MHz to 2170 MHz, and it is seen that the antenna apparatus operates in a plurality of bands.

Figure 17:
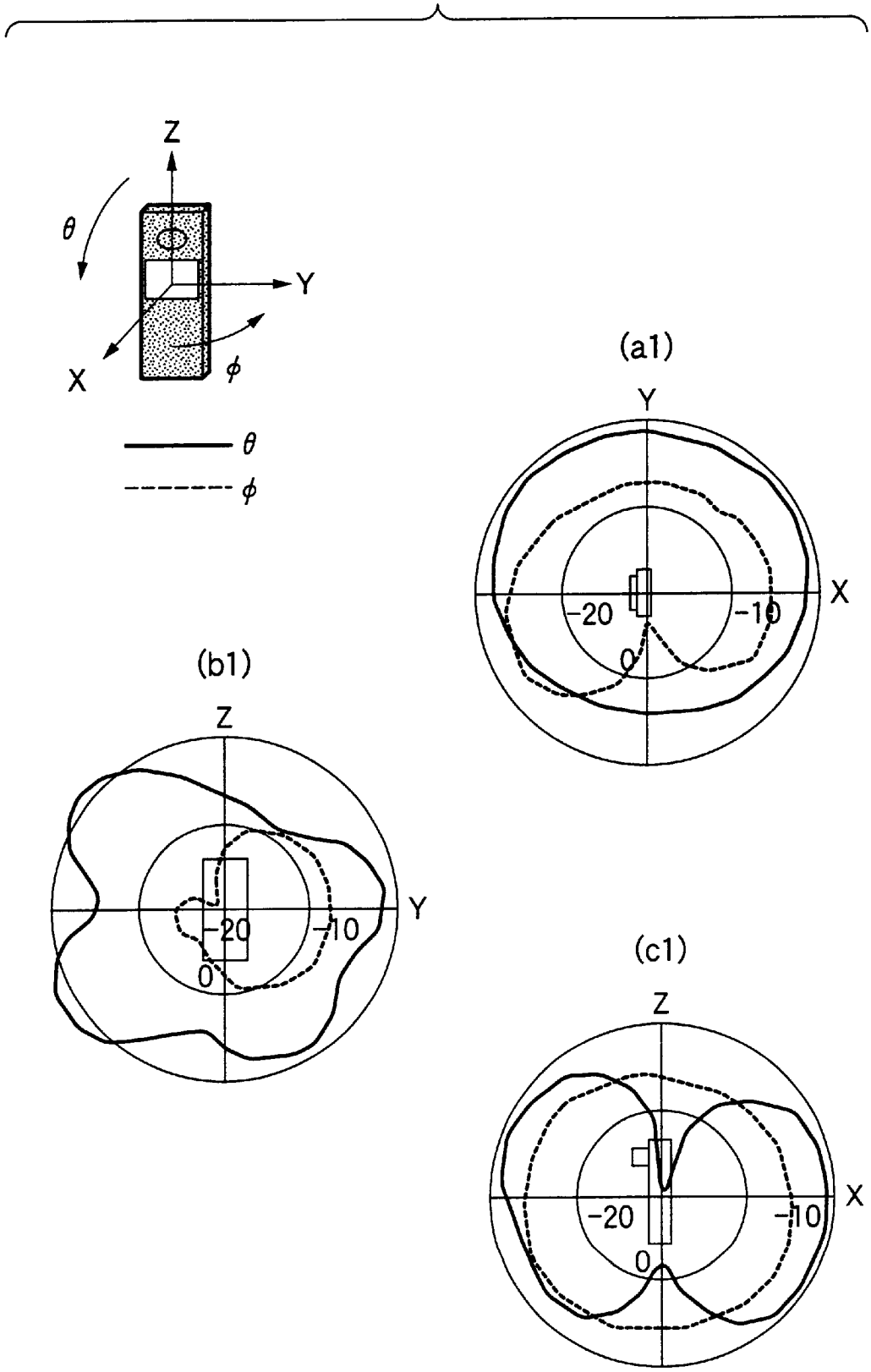
FIG. 17 is a characteristic drawing to show the radiation directivity in a first frequency band of the antenna apparatus in FIG. 15.
Figure 18:
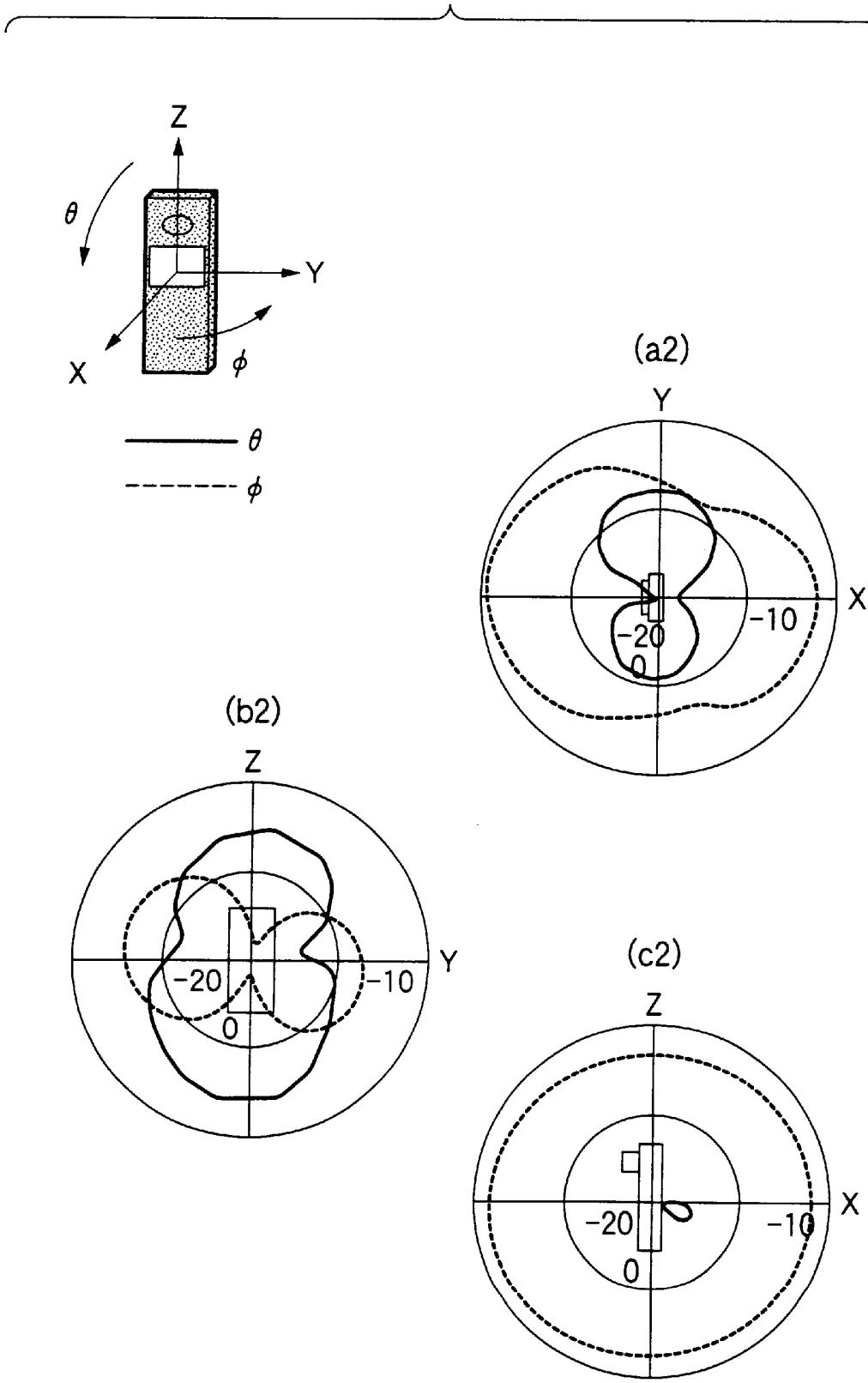
FIG. 18 is a characteristic drawing to show the radiation directivity in a second frequency band of the antenna apparatus in FIG. 15.
Figure 19:
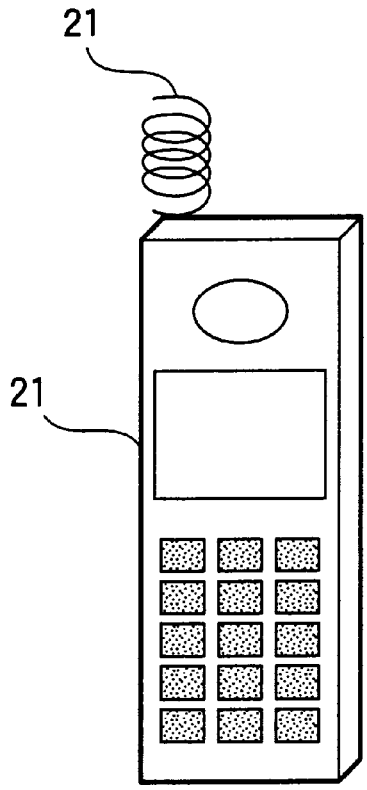
FIG. 19 is a perspective view of a radio comprising a fixed-type helical antenna in a related art.
Figure 20:
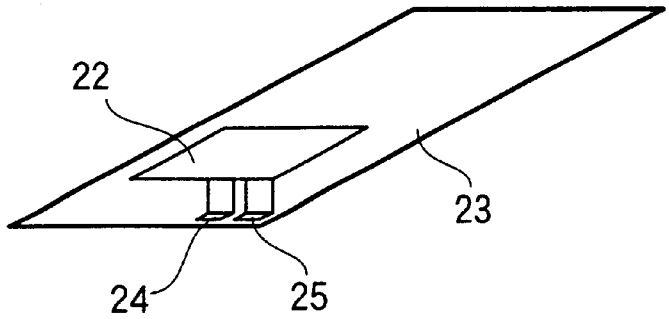
FIG. 20 is a drawing to show the structure of a plate-like inverse F antenna in a related art.

FIGS. 17 and 18 are characteristic drawings to show the radiation directivities of the antenna apparatus described with reference to FIG. 16. FIG. 17 shows the radiation directivity patterns in the first frequency band and FIG. 18 shows the radiation directivity patterns in the second frequency band. In FIG. 18, (a2), (b2), and (c2) show the radiation directivity patterns applied when the antenna apparatus performs the balanced operation as with the radiation directivity of the antenna apparatus of the first embodiment shown in FIG. 4, but it is seen that θ component (Eθ) increases on the X-Z plane in (c1) of FIG. 17 and the antenna apparatus performs slightly unbalanced operation. In (cl) of FIG. 17, as the θ component (Eθ) increases on the X-Z plane, ϕ component (Eϕ) decreases accordingly, and current on the loop antenna element 103 and current on the passive element 106 decrease, resulting in such directivity. A part of the antenna apparatus is thus formed as an asymmetrical structure, whereby balanced system and unbalanced system antennas can coexist and the optimum radiation directivity can be formed in response to the operating environment, arrival radio wave, and operating frequency band difference, so that a highly sensitive antenna system can be provided.

As seen from the description made above, with the antenna apparatus of the invention, the current component flowing on the top of the base plate of the radio containing the antenna apparatus is lessened, whereby when the radio is brought close to a human body for use, degradation of the gain can be suppressed. The turn-up structure and the passage element are placed, whereby a balanced system antenna generally having a narrow band can be used in a wide band. Further, the function of switching balanced and unbalanced systems is added, so that a radiation pattern responsive to the radio wave environment and the operating environment can be formed.

Thus, small-sized, wide-band, and high-gain antenna apparatus whose characteristic degradation caused by a human body is small and which can also be used in a wide-band radio communication system, enabling high-quality and stable mobile communications.

What is claimed is:

1. An antenna apparatus being housed in a portable radio main unit, comprising:

a loop antenna element which is shaped substantially rectangle with a ratio between a short side and a long side being 10 or more, wherein the loop antenna element has an outer peripheral length which is roughly the same as one wavelength, λ, at a first frequency, wherein the loop antenna element is placed close in parallel to a radio base plate with a spacing of at least 0.0067λ, wherein the loop antenna is turned up so that the short side is brought close to a feeding section side such that the loop antenna has a height of at least 0.067λ.

2. The antenna apparatus as claimed in claim 1, wherein a current distribution of the short side of the loop antenna element is zero.

3. The antenna apparatus as claimed in claim 1, wherein the loop antenna element is connected to a balanced feeding line.

4. The antenna apparatus as claimed in claim 1, further comprising at least a passive element placed with a sufficiently small spacing as compared with the wavelength along the loop antenna element.

5. The antenna apparatus as claimed in claim 4, wherein the passive element has a resonance frequency different from the first frequency.

6. The antenna apparatus as claimed in claim 4, wherein at least a part of at least one of the loop antenna element and the passive element is shaped like a plate.

7. The antenna apparatus as claimed in claim 4, wherein at least one of the loop antenna element and the passive element is formed on a structure of one of resin, ceramic, and a printed circuit board.

8. An antenna apparatus being housed in a portable radio main unit, comprising:

a loop antenna element which is shaped substantially rectangle with a ratio between a short side and a long side being 10 or more;

at least a passive element placed with a sufficiently small spacing as compared with the wavelength along the loop antenna element; and a unit for changing a ratio between a current flowing onto the loop antenna element and a high-frequency current flowing onto the radio base plate;

wherein the loop antenna element has an outer peripheral length which is roughly the same as one wavelength at a first frequency, wherein the loop antenna element is placed close in parallel to a radio base plate with a sufficiently small spacing as compared with the wavelength, wherein the loop antenna is turned up so that the short side is brought close to a feeding section side.

9. The antenna apparatus as claimed in claim 8, wherein the antenna element is connected to balanced feeding line, further comprising an adjustment unit for providing a phase difference between the balanced feeding line and the antenna element.

10. The antenna apparatus as claimed in claim 8, wherein at least one of the loop antenna element and the passive element is asymmetrical with respect to the feeding section.

11. The antenna apparatus as claimed in claim 1, wherein at least a part of the loop antenna element is shaped like a plate.

12. The antenna apparatus as claimed in claim 1, wherein the loop antenna element is formed on a structure of one of resin, ceramic, and a printed circuit board.

13. An antenna apparatus being housed in a portable radio main unit, comprising:

a loop antenna element which is shaped substantially rectangle with a ratio between a short side and a long side being 10 or more; and a unit for changing a ratio between a current flowing onto the loop antenna element and a high-frequency current flowing onto the radio base plate;

wherein the loop antenna element has an outer peripheral length which is roughly the same as one wavelength at a first frequency, wherein the loop antenna element is placed close in parallel to a radio base plate with a sufficiently small spacing as compared with the wavelength, wherein the loop antenna is turned up so that the short side is brought close to a feeding section side.

14. The antenna apparatus as claimed in claim 13, wherein the antenna element is connected to balanced feeding line, further comprising an adjustment unit for providing a phase difference between the balanced feeding line and the antenna element.

15. The antenna apparatus as claimed in claim 13, wherein the loop antenna element is asymmetrical with respect to the feeding section.

16. An antenna apparatus being housed in a portable radio main unit, comprising: a loop antenna element which is shaped substantially rectangle with a ratio between a short side and a long side being 10 or more, wherein the loop antenna element has an outer peripheral length which is roughly the same as one wavelength at a first frequency, wherein the loop antenna element is placed close in parallel to a radio base plate with a sufficiently small spacing as compared with the wavelength, wherein the loop antenna is turned up so that the short side is brought close to a feeding section side, wherein the sufficiently small spacing is equal to about 0.0067 times the wavelength.

17. An antenna apparatus being housed in a portable radio main unit, comprising:

a loop antenna element which is shaped substantially rectangle with a ratio between a short side and a long side being 10 or more, wherein the loop antenna element has an outer peripheral length which is roughly the same as one wavelength at a first frequency, wherein the loop antenna element is placed close in parallel to a radio base plate with a sufficiently small spacing as compared with the wavelength, and the loop antenna element is positioned proximate one end of the radio base plate, wherein the loop antenna is turned up so that the short side is brought close to a feeding section side.

18. The antenna apparatus as claimed in claim 17, wherein the loop antenna is further turned up in a direction perpendicular to and towards a feeding section side.

19. The antenna apparatus as claimed in claim 17, wherein a gap between the short side and a second short side is equal to or less than about 0.067 times the wavelength.

20. The antenna apparatus as claimed in claim 17, wherein said loop antenna element is directly mounted on said radio baseplate.

* * * * *